United States Patent [19]

Stöger

[11] 4,124,833

[45] Nov. 7, 1978

[54] OVERCURRENT PROTECTION EQUIPMENT

[76] Inventor: Max H. Stöger, Herzogstandstrasse 16, D-8120 Weilheim, Fed. Rep. of Germany

[21] Appl. No.: 766,696

[22] Filed: Feb. 8, 1977

[30] Foreign Application Priority Data

Feb. 11, 1976 [DE] Fed. Rep. of Germany ..... 2605378

[51] Int. Cl.[2] ..... H01H 3/02; H01H 3/12

[52] U.S. Cl. ..... 335/186; 335/173; 337/66

[58] Field of Search ..... 335/186, 189, 22, 169, 335/173, 72, 121, 140, 164, 238; 337/66

[56] References Cited

U.S. PATENT DOCUMENTS 1,925,836 9/1933 Johnsson ..... 335/186

FOREIGN PATENT DOCUMENTS 1,287,676 1/1969 Fed. Rep. of Germany ..... 335/186

*Primary Examiner*—Harold Broome

*Attorney, Agent, or Firm*—Jerry Cohen

[57] ABSTRACT

Electrical on-off switching system, particularly for process control, having a bimodal operation with a first operational, low current, mode response and second emergency, high current, mode, comprising multiple sets of switch contacts and separate linkages for the first and second modes arranged such that the spreading of switch contacts for electrical circuit interruption is less in the first mode than in the second and further comprising a snap action in both modes of operation and non-interference between the linkages providing the two modes of operation.

6 Claims, 4 Drawing Figures

OVERCURRENT PROTECTION EQUIPMENT

This invention relates to a regulating or control appliance with excess current protection equipment of the kind including a circuit-breaker with at least one conductor path in the course of which at least one pair of contacts is arranged, consisting of a first contact mounted on a first contact carrier and a second contact mounted on a second contact carrier, which second contact can be transferred by relative movement of the contact carriers from a closing position to an opening position and vice versa, a protective relay bringable into operating position with loading of an energy-storing spring, which protective relay trips in the event of excess current or short circuiting and effects with the released spring power a relative movement of the contact carriers leading to a contact separation necessary for the removal of excess current (or short circuiting current respectively) and a measuring element converting the change of a physical quantity without auxiliary energy into a mechanical movement, which measuring element is drivingly connected through a snap-action spring device with the second contact carrier and effects movement thereof relative to the first contact carrier.

Regulating or control appliance with excess current protection equipment of this kind are known (Federal German patent specification No. 1,287,676 as published on acceptance) and are used specially as pressure or float monitors. In these cases the pressure monitor opens or closes its electric contacts being interconnected in the feeding circuit of a pump motor for example as a function of the pressure head of a fluid or as a function of the level of a head of liquid respectively. The operation of the electric contacts takes place through interpositioning of a snap-action device according to the rocker arm or wire snap system.

The excess current protection equipment should protect from overload the appliance regulated or controlled from the equipment, for example the said pump motor, and also effect protection from short circuiting. For this purpose it is necessary to separate the contacts from one another to such an extent that the arc can be quenched with certainty. The separation of the contacts on releasing excess current and especially on short circuiting must therefore be substantially greater than would be necessary for mere switching off of the working current in normal switch operation of the appliance induced by the measuring element.

If therefore, as in the case of the hitherto-proposed appliance, for reasons of economy, the same switch is to be used for the breaking of the excess current circuit and the breaking of the currents appearing in the event of normal switch operation of the connected equipment, the contact separation in the sense of opening can not be limited to such smaller value sufficient for the normal switch operation, as the greater separation of contacts must be available for the occurrence of excess current or short circuiting. On account of this large opening path of the contacts, the snap-action device must be appropriately dimensioned and the energy necessary for actuating the snap-action device must be appropriately large.

As a rule the energy supplied from a measuring element depends on the extent of change in the monitored physical quantity. Therefore the smaller is the energy to be provided from the measuring element for the actuation of the snap-action device, the smaller the changes which can be measured in the physical quantity.

The problem to be solved by the invention is so to develop the known appliance as initially described, that in use of one and the same circuit-breaker switch for carrying out the regulating or control function and for breaking off a given excess current the energy to be provided by the measuring element for actuation the circuit-breaker switch is reduced without use of auxiliary energy and thereby a higher response sensitivity on changes in the monitored physical quantity is achieved, or that with a given response sensitivity or space requirement for the measuring element a higher making and breaking capacity is attained in the normal switch operation.

According to the present invention, I provide a regulating or control appliance with excess current protection equipment of the kind stated in which the first contact carrier is kept fast with the casing at least in the operating (not-released) position of the protective relay, the protective relay being coupled without intervention of the snap-action spring device to the contact carriers, as to effect the relative movement of said contact carriers and a stop not movable from the snap-action spring device limits the regular opening movement of the second contact carrier relative to the circuit-breaker casing to a value at which the contact separation when the protective relay is not released is smaller than necessary for shortcircuit interruption, but is sufficient to interrupt the current occurring in the regular regulating or control operation.

Through the development according to the invention the movement of the contacts can be limited to a value which is quite sufficient for interrupting the current occurring operationally. Accordingly the energy to be supplied in order for the snap-action spring device to bring about a switch-over of the circuit is low.

The correspondingly greater energy to be applied for the greater movement on short-circuiting or excess-current interruption may be simply made available by appropriate dimensioning of the energy-storing spring of the protective relay, tensioned in the usual way by pressing in a pushbutton.

In the development according to the invention, the first contact carrier not actuated by the snap-action spring device is fixedly united with the circuit-breaker casing, a control member driven from the energy-storing spring of the relay is coupled with the second contact carrier actuable from the snap-action spring device leaving a clearance permitting the closing of the contacts by the snap-action spring device when the protective relay is not tripped, and the said stop is resilient and is displaceable by the energy-storing spring of the relay.

The stop is preferably pressed by a spring against a shoulder which defines its position determining the opening movement of the second contact carrier, and the spring is so designed that on tripping of the protective relay from its energy-storing spring the stop can be lifted from its shoulder with increase of the regular opening movement of the contacts.

In a further development in accordance with the invention, the first contact carrier is movably supported in the circuit-breaker casing with a travel sufficient for the release (interruption) of excess current, is mechanical coupled with the control member driven from the energy-storing spring of the relay and is held in a predetermined position by the control members when the protective relay is in the operating position, and in which the second contact carrier is movably supported in the circuit-breaker casing with a travel sufficient for the release (interruption) of the current occurring in the regular regulating or control operation, and the stop is formed fast with the casing.

This construction in accordance with the invention has the advantage that any reaction whatsoever on the second contact carrier, the snap-action spring device and the measuring element and emanating from the protection relay is excluded. The regular switching movement of the second contact carrier is completely independent of and is not influenced by the switching movement of the first contact carrier tripped by the protection relay in the event of excess current or short circuiting.

Moreover there is no need to design the stop to be movable as this can be constructed to be fast with the circuit-breaker casing. Furthermore the co-ordination between the snap-action spring device and the spring pressing the stop against a shoulder is not necessary.

In another development in accordance with the invention the first contact carrier is movably supported in the circuit-breaker casing, is mechanical coupled with the control member driven from the energy-storing spring of the relay and is held in a predetermined position by the control members when the protective relay is in the operating position, and in which the first contact carrier is connected with the second contact carrier by way of mechanical gearing, which drives the second contact carrier in the opposite direction to the first contact carrier, when the last is driven in the opening sense of its contacts, and which does not hinder the regular opening and closing position of the second contact carrier effected from the measuring element by way of the snap-action spring device, when the first contact carrier is held in a predetermined position.

Through this construction according to the invention the displacement of the first contact carrier in relation to the circuit-breaker casing can be smaller in that the second contact carrier is moved positively into the opening position in the event of excess current or short circuiting.

The first contact carrier and the second contact carrier may both be constructed in the form of slides and are movably mounted in mutually parallel guideways in the contact-breaker casing.

Four non-limitative embodiments of the invention are represented in the drawings in which.

Figure 1:
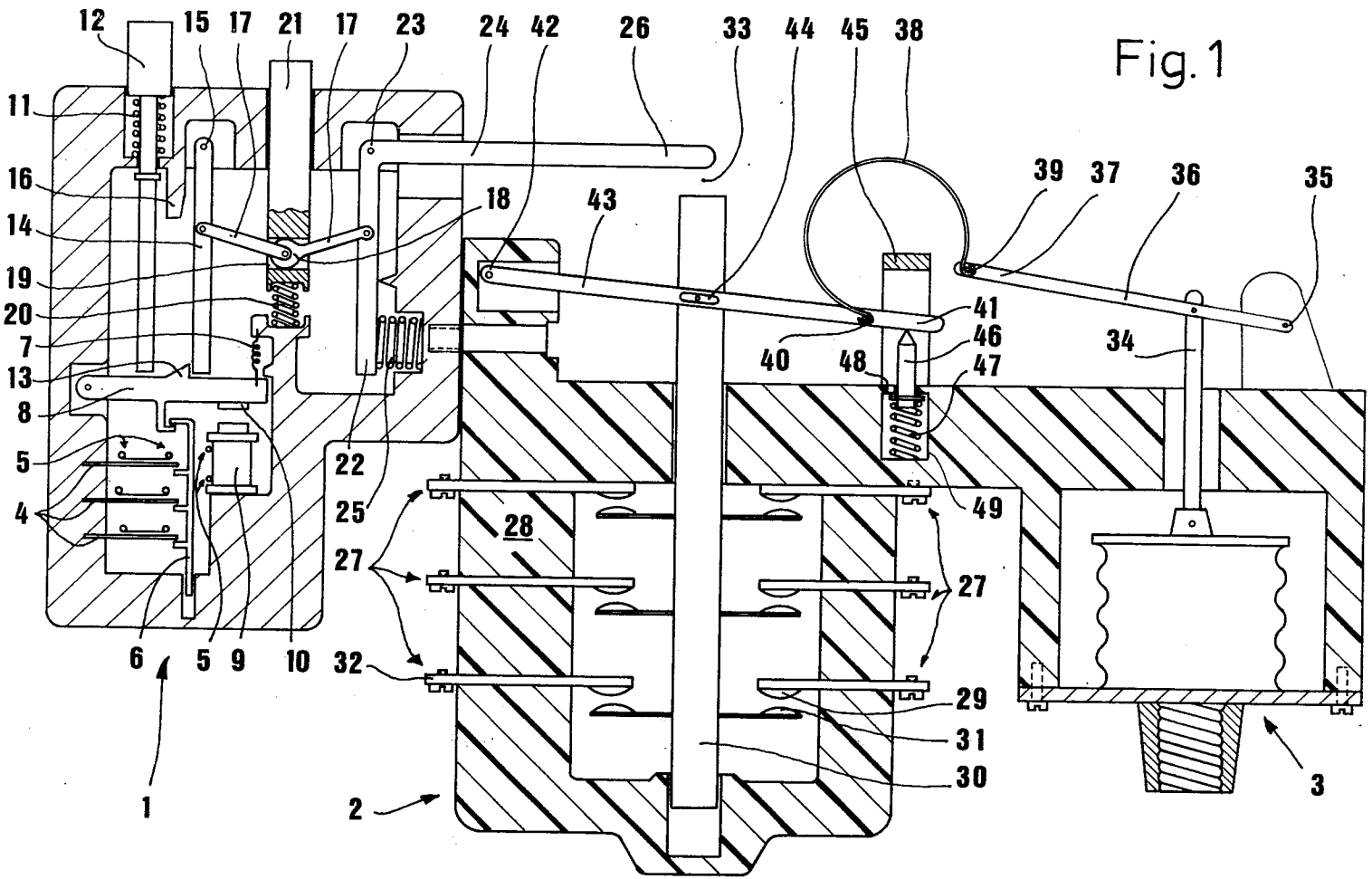
FIG. 1 is a section through a regulating and control appliance with excess current protection equipment with a first contact carrier fast with the casing and a movable second contact carrier according to a first embodiment.

The two embodiments shown in FIGS. 1 and 2 both consist essentially of the protection relay 1, contact-breaker with casing 2 and measuring element 3 to be more fully described in the following. All three arrangements of parts are combined into a single assembly.

Within the protection relay 1 are three bimetal trips 4 provided with heating elements of a thermal excess current tripping device, which are electrically connected into the load circuit through the terminals 5 and are heated and deflect on overload. The deflecting bimetal trips 4 move a tripping slide 6 which acts on the tripping lever 8 held in its initial position by a return spring 7.

An electromagnet 9 which is electrically connected into the load circuit through the terminals 5 can act on a armature 10 mounted on the tripping lever 8 in the event of electromagnetic excess current tripping. Finally there can act on the tripping lever 8 also independently of the thermal and electromagnetic excess current trippers a push button cut-out 12 held by a spring 11.

Through the action of the tripping lever 8 a detent 13 mounted on the lever releases a locking lever 14 which is mounted for turning about a fixed spindle 15, the turning movement being limited by a stop 16.

The locking lever 14 is connected mounted by way of two connecting rods 17 and the intermediary of a toggle joint mechanism 18 known per se, and which is displaceably supported in a guide opening 19 of the push button cut 21 which is under the influence of a compression spring 20, with the first arm 22 of a control member 24 in the form of an angle lever and supported for rotation about the fixed spindle 23.

An energy storing spring 25 acts on the second arm 22 of the control member 24.

During the tripping procedure the control member 24 driven from the energy storing spring 25 operates the arrangement of connecting (switch) bridges represented with reference to four embodiments in FIGS. 1 to 4 and which are mounted in the circuit-breaker casing.

The circuit-breaker casing 2 shown in FIG. 1 includes a triple connecting-bridge arrangement which consists essentially of three conductor paths 27 in the courses of each of which are arranged two pairs of contacts, consisting of first contacts 29 arranged on an insulating first contact carrier 28 forming a component of the circuit-breaker casing <> and second contacts 31 arranged on an insulating second contact carrier 30. < and which are connected with the load circuit by means of the contact vanes 32>. The first contact carrier 28 is therefore stationary in this embodiment according to FIG. 1.

The second contact carrier 30 is movable mounted in the circuit-breaker casing 2 so that the second contacts 31 secured thereto can effect a relative movement in relation to the first contacts 29 fast with the casing.

The relative movement between the contacts 29 and 31 is effected, on the occurrence of excess current, through the protection relay 1 in consequence of tripping of the control member 24 and, in the regular regulating and control operation, by a circuit-breaker mechanism independent of the protective relay and not influencing the latter and driven from the measuring element 3.

Before however the manner of operation of the actual circuits is described there will first of all be explained in the following the mechanism controlling the regular operation and driven from the measuring element 3.

The measuring element 3, shown in FIG. 1 as a bellows, may also be a float or other measuring element and transmits its movement generated through the change of the medium to be monitored, by way of a take-off member 34 on the lever 36 pivoted on the fixed spindle 35. At the free end 37 of the lever 36 there is an omega spring 38 with its first end 39 movably supported and the second end 40 of the omega spring 38 is again movably connected with the free end 41 of a control lever 43 turnable about a spindle 42 fixed to the circuit-breaker casing 2. This control lever 43 is connected with the second contact carrier 30 through a slot connection 44.

The control lever 43 turnable about the spindle 42 is so driven from the omega spring 38 that it comes to bear either on the upper fixed stop 45 or on the lower movable stop 46.

The movable stop 46 is so supported in the circuit breaker casing 2 that it is pressed against a shoulder 48 fast with the casing by a compression spring 47 disposed in bore 49.

In FIG. 1 the connecting bridge arrangement is shown in the off-position of the regulating or control circuit. The device to be controlled, for example the motor of a direct-connected motor-driven pump, is switched off. If now the pressure of the medium to be regulated goes down, the take-off member 34 secured to the measuring element 3 moves the lever 36 downwardly. The omega spring 38 is also taken along through its free end 39 by the lever 36. As soon as the free end 39 of the omega spring 38 is a little below a line through the spindle 42 and the end 40 of the omega spring 38, the free end 40 of the omega spring 38 will spring upwardly and take along the control lever 43 upwardly against the fixed stop 45, taking along the second contact carrier 30 to close contacts 29, 30. Through this the motor of the motor driven pump is switched on.

Conversely on attaining the maximum compression the omega spring 38 will spring back to its position shown in FIG. 1 and bring the control lever 43 to bear against the movable stop 46. The compression spring 47 is of such power that the movable stop 46 can accommodate the energy required to operate the omega spring 38 when moving out of the position shown in FIG. 1. Even a momentary deflection of this resilient stop 46 would merely favour the switching off of the regular working current.

In the case of a short circuit the control member 24 is tripped by the protection relay 1 and the second arm 26 moves the second contact carrier 30 promptly downwardly while overcoming the resilient force of the movable stop 46 acting on the control lever 43 in the tripping position.

Figure 2:
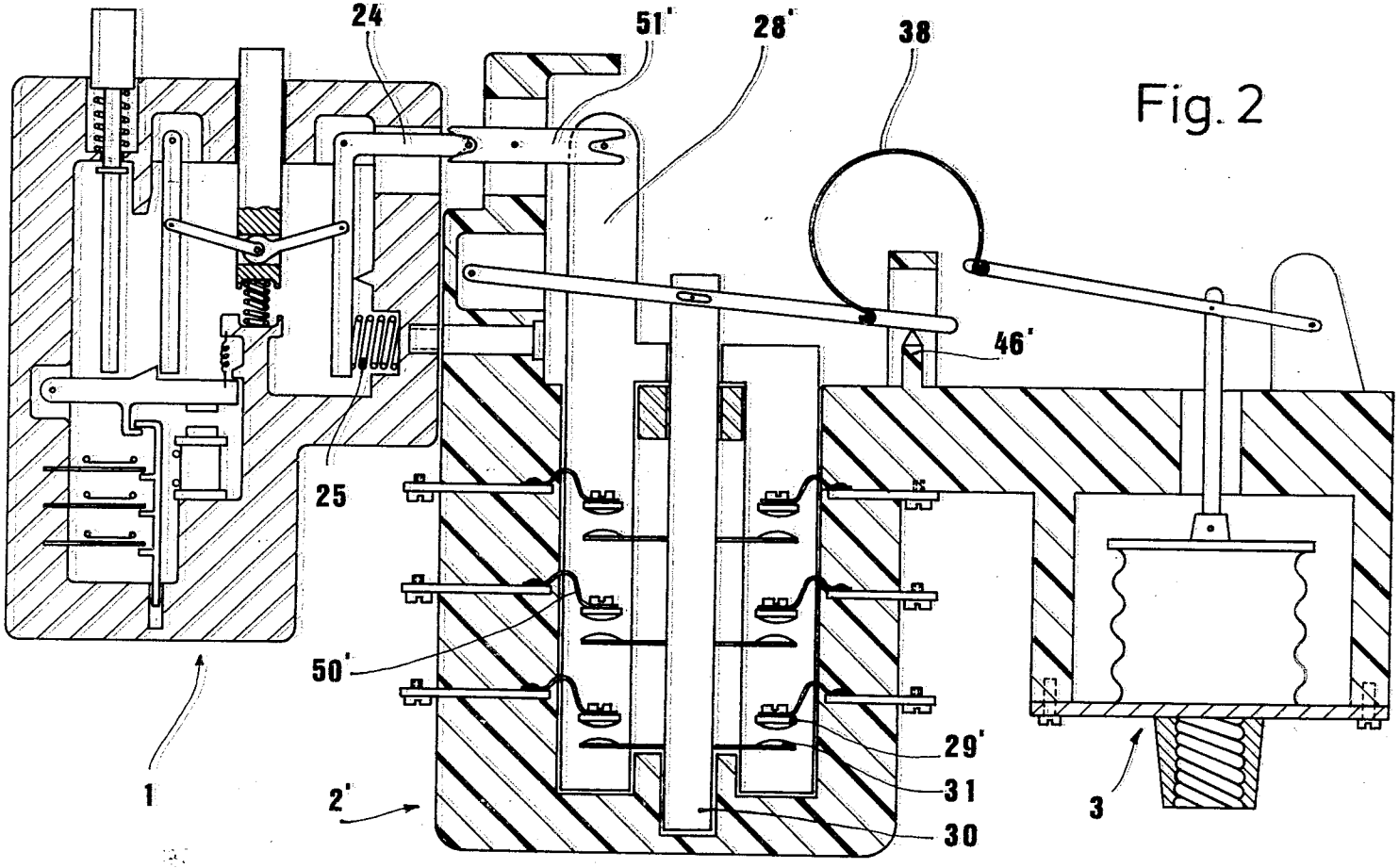
FIG. 2 is a section through a regulating and control appliance with excess current protection equipment with movable first and second contact carrier according to a second embodiment.

The second embodiment of the invention shown in FIG. 2 consists likewise of a combination of protection relay 1, circuit breaker casing 2', and measuring element 3. The arrangement of the measuring element 3 and the transfer of the measured quantity to the second contact carrier 30 of the circuit breaker casing 2' with interpositioning of a snap action spring device with omega spring 38 is identical with the arrangement shown in FIG. 1. The only difference is that the stop 46' is no longer movable but is constructed to be fast with the casing, as through the special arrangement of the first contact carrier 28' a deflection of the stop 46' is not necessary.

The essential difference from the first embodiment is the movable construction of the first contact carrier 28'. The first contacts 29' are no longer fixedly connected with the circuit-breaker casing 2' and the contact vanes 32, but are on the movable supported first contact carrier 28' and are movably connected with the contact vanes 32 through flexible wires 50'.

The first contact carrier 28' projects beyond the top of the circuit-breaker casing 2' and is coupled through a lever device 51' with the second arm 26 of the control member 24 of the protection relay 1. Moreover a pin 52', provided at the end of the second arm 26 of the control member 24, meshes into a slot 53' of the lever-device 51'.

The regular regulating or on/off operation takes place as described in the first embodiment by movement of the second contact carrier 30. In the event of a short circuit however after tripping of the control member 24 driven by the energy storing spring 25 is so moved that the first contact 29' is sufficiently far separated from the second contacts 31 for a short circuit interruption whether or not the connecting bridge is in the open or closed position.

Figure 3:
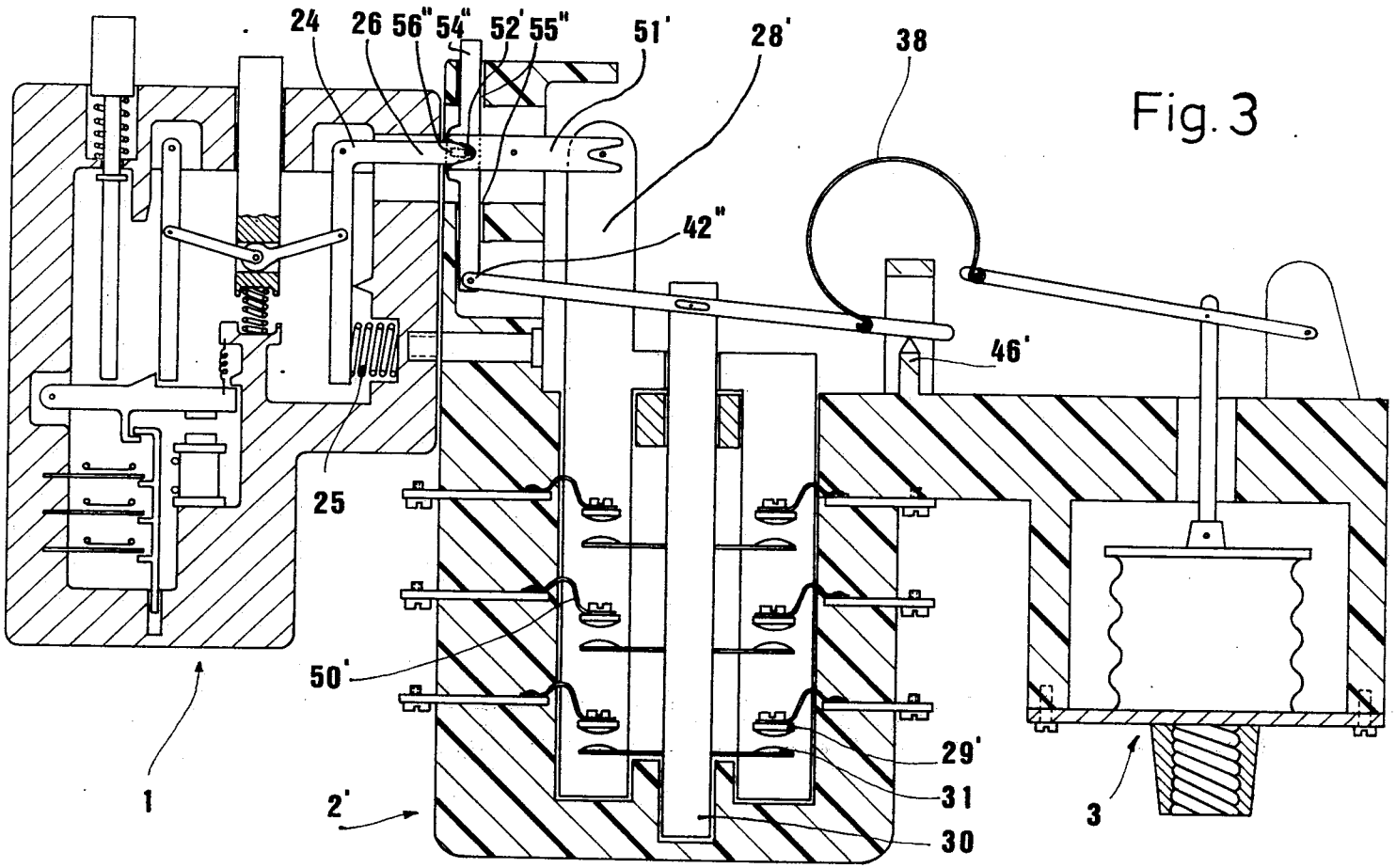
FIG. 3 is a section through a regulating and control appliance with excess current protection equipment according to FIG. 2 and an additional arranged gear-lever.

The third embodiment of the invention shown in FIG. 3 is identical to the second embodiment shown in FIG. 2 except some supplements described in the following.

The third embodiment shows an addditional provided gear-lever 54'', which is guided in bores 55'', provided in the circuit-breaker casing 2'. In further alternation the end of the control lever 43, beared turnable about a spindle 42 fixed to the circuit-breaker casing 2,2' in the embodiments shown in FIG. 1 and 2 is movable connected with the lower end of the gear-lever 54'' in this third embodiment.

Furthermore the gear-lever 54'' is connected with the second arm 26 of the control member 24 of the protection relay 1 by a slot connection 56'' by the pin 52', provided at the end of the second arm 26 in that way that after release of the control member 24 driven from the energy storing spring 25 the gear-lever 54'' is moved downwards and moves by the movable connected control lever 43 in the second contact carrier into its opening position.

At the same time the movable first contact carrier 28' is so displaced that the first contacts 29' become sufficiently disconnected from the second contacts 31. By this embodiment, shown in FIG. 3, the displacement of the first and second contact carriers in relation to the circuit-breaker casing 2' becomes advantageous smaller, but on the whole a sufficient far opening position in the event of excess current or short circuiting is effected.

Figure 4:
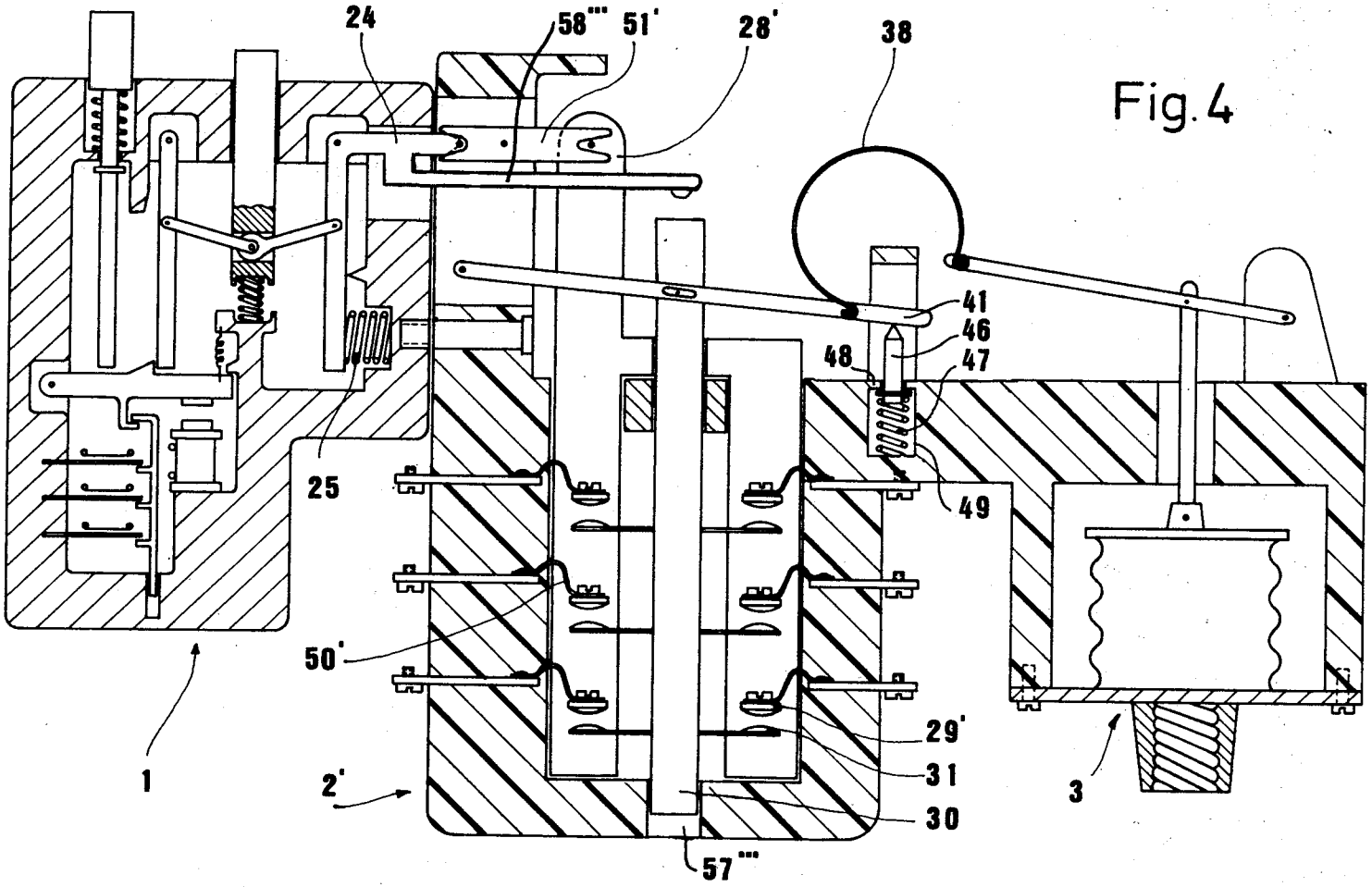
FIG. 4 is a section through a regulating and control appliance with excess current protection equipment according to FIG. 2 with an additional arrangement of a movable stop and an additional operating lever.

The same advantage can be effected by the fourth embodiment according to the invention, shown in FIG. 4. Coming from the embodiment shown in FIG. 2 the stop 46', constructed to be fast with the casing, is now constructed movable as the stop 46 shown in FIG. 1. A bore 57'' is provided in the botten of the circuit-breaker casing 2', so that the movable second contact carrier 30 can move unhindered.

Finally, in alternation to FIG. 2 and similar to the embodiment shown in FIG. 1, the control member 24 is supplied by an additional control member 58''', which moves, driven by the energy storing spring 25 in the case of excess current or short circuiting, the second contact carrier 30 promptly downwardly while overcoming the resilient force of the movable stop 46 acting on the control lever 43 in the tripping position.

At the same time the first contact carrier is also moved upwardly in opposite direction of the second contact carrier by the second arm 26 of the control member 24 and the inserted lever device 51'.

A sure disconnection of the contacts and with that an interruption of the circuit is guaranteed.

What I claim is:

1. Electrical bimodal (on-off) control and emergency high current protection switch assembly for an electrical control circuit, said switch assembly using the same electrical contacts for the control purpose and for emergency high current protection, comprising, switch means having at least one conductor path to be interconnected in the electrical circuit to be controlled, each conductor path having at least one pair of electrical contacts and first and second contact carriers wherein one contact of each pair is mounted on said first contact carrier and the other contact of each pair is mounted on said second contact carrier.

casing means, the first contact carrier and the second contact carrier being arranged in said casing means for relative movement therein limited in one direction by the closing of the pair(s) of contacts and having at least an extent of travel in the other direction corresponding to a spread of said contacts sufficient for emergency high current interruption, at least one of said contact carriers being movably guided in said casing means for relative movement therebetween, protective relay means responsive to emergency high current conditions comprising an energy storing spring, a first switch actuating member which is displaceable by said spring, and a control linkage mechanically coupled to said actuating member, the control linkage comprising means for moving the first actuating member and the spring each from a first released position into a second operational position in which the spring is more tensioned than it is when in said first released position and further comprising latching means for locking the first actuating member and spring in said second position, releasing means for interconnecting in said electrical circuit and responsive to emergency high current conditions and coupled to the latching means for unlocking the same, under the emergency condition, the first actuating member being free to be displaced under the action of energy storing spring from its second operational to its first released position in the unlocked state, measuring means responsive to the change of a physical quantity and comprising an element displaced as a function of said physical quantity, said element being coupled through a snap-action spring device to a second actuating member, the second actuating member being coupled with said second contact carrier moveably guided in said casing means a stop for limiting the movement with respect to said casing means of said second actuating member and second contact carrier induced by said snap action spring device in the contact opening sense to a value smaller than necessary for short-circuit interruption but sufficient for interruption of current occurring in the regular non-emergency operation, the first actuating member being coupled without intervention of said snap-action spring device to the switch means for inducing relative movement of said first and second contact carriers in the sense of contact-spreading when moving from the second operational to the first released position of said actuating means under emergency conditions, to effect the widest spreading of the contacts.

2. A regulating or control appliance with excess current protection equipment in accordance with claim 1 in which the first contact carrier is fixedly united with the casing means, the first switch actuating member is coupled with the second contact carrier so as to allow unhindered movement of the second contact carrier, when movement is induced by the snap-action spring device when the first actuating member is in its second operational position and wherein the stop is resilient and is displaceable by the energy-storing spring of the relay.

3. A regulating or control appliance with excess current protection equipment in accordance with claim 2, in which the stop is pressed by a spring against a shoulder fixed to said casing means which defines its position determining the contact opening position of the second contact carrier under action of said snap-action device, and the spring is so designed that, after unlocking the first actuating member its energy-storing spring can lift the stop from its shoulder to effect widest spreading of the contacts.

4. A regulating or control appliance with excess current protection equipment in accordance with claim 1, in which the first contact carrier is movably supported in the casing means with a travel sufficient for the interruption of emergency high current, is positively mechanically coupled with the first switch actuating member and is held in a predetermined position by said first actuating member when the protective relay is in the second operational position, and in which the second contact carrier is movably supported in the circuit breaker casing with a travel sufficient for the interruption of the current occurring in the regular regulating or control operation, and the stop, which limits the opening-travel of the second contact carrier, is fixedly united with the casing means.

5. A regulating or control appliance with excess current protection equipment in accordance with claim 1 in which the first contact carrier is movably supported in the casing means, is mechanically coupled with the first switch actuating member and is held in position by the first actuating member's being in its second operational position, and in which the first contact carrier is connected with the second contact carrier by way of mechanical gearing, which drives the second contact carrier in the opposite direction with respect to the first contact carrier, when the latter is driven in the opening sense of its contacts, and which does not hinder the regular opening and closing movement of the second contact carrier effected from the measuring means by way of the snap-action spring device, when the first contact carrier is held in the mid-predetermined position.

6. A regulating or control appliance with excess current protection equipment in accordance with claim 4 in which the first contact carrier and the second contact carrier are both constructed as slides and are movably mounted in mutually parallel guideways in the casing means.

* * * * *